US011551852B2

(12) United States Patent
Takai et al.

(10) Patent No.: US 11,551,852 B2
(45) Date of Patent: Jan. 10, 2023

(54) COIL COMPONENT

(71) Applicant: Murata Manufacturing Co., Ltd., Kyoto-fu (JP)

(72) Inventors: Shun Takai, Nagaokakyo (JP); Masayuki Oishi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 438 days.

(21) Appl. No.: 16/775,087

(22) Filed: Jan. 28, 2020

(65) Prior Publication Data

US 2020/0251273 A1 Aug. 6, 2020

(30) Foreign Application Priority Data

Feb. 4, 2019 (JP) ..... JP2019-017817

(51) Int. Cl.

*H01F 27/28* (2006.01)
*H01F 41/04* (2006.01)
*H01F 27/29* (2006.01)

(52) U.S. Cl.

CPC ..... *H01F 27/2804* (2013.01); *H01F 41/041* (2013.01); *H01F 27/29* (2013.01); *H01F 2027/2809* (2013.01)

(58) Field of Classification Search

CPC .... H01F 27/2804; H01F 41/041; H01F 27/29; H01F 2027/2809

USPC ..... 336/200

See application file for complete search history.

(56) References Cited

U.S. PATENT DOCUMENTS

2012/0326827 A1* 12/2012 Nanjyo ..... H01F 17/0033 336/200
2015/0014042 A1* 1/2015 Noguchi ..... H05K 1/165 174/262
2017/0025219 A1* 1/2017 Nagai ..... H01F 17/0013
2017/0186541 A1* 6/2017 Hong ..... H01G 4/12
2017/0208677 A1* 7/2017 Kogure ..... H01L 23/12
2018/0233262 A1* 8/2018 Nagai ..... H01F 27/292
2018/0323005 A1* 11/2018 Sato ..... H01F 17/0013

FOREIGN PATENT DOCUMENTS

JP 2000-021666 A 1/2000
JP 2002-343640 A 11/2002
JP 2005-072267 A 3/2005
JP 2017-059749 A 3/2017

OTHER PUBLICATIONS

An Office Action; "Notice of Reasons for Refusal," mailed by the Japanese Patent Office dated Sep. 21, 2021, which corresponds to Japanese Patent Application No. 2019-017817 and is related to U.S. Appl. No. 16/775,087 with English translation.

* cited by examiner

*Primary Examiner* — Alfonso Perez Borroto
(74) *Attorney, Agent, or Firm* — Studebaker & Brackett PC

(57) ABSTRACT

A multilayer coil component including an element assembly that includes an insulator portion and a coil embedded in the insulator portion and composed of a plurality of coil conductors electrically connected to each other, an extension portion disposed at each end portion of the coil, and an outer electrode disposed on the surface of the insulator portion and electrically connected to the extension portion. The thickness of the coil conductor in the extension portion of the coil is about 1.05 times or more and 2.0 times or less (i.e., from about 1.05 times to 2.0 times) the thickness of the coil conductor in a winding portion of the coil.

10 Claims, 8 Drawing Sheets

COIL COMPONENT

CROSS-REFERENCE TO RELATED APPLICATION

This application claims benefit of priority to Japanese Patent Application No. 2019-017817, filed Feb. 4, 2019, the entire content of which is incorporated herein by reference.

BACKGROUND

Technical Field

The present disclosure relates to a multilayer coil component.

Background Art

In a multilayer coil component, stress is generated between an insulating portion and a coil in an element assembly, and variations may occur in the electrical characteristics of the multilayer coil component due to the influence of the stress. Therefore, relaxation of such stress has been desired. In Japanese Unexamined Patent Application Publication No. 2017-59749, stress is relaxed by forming a stress relaxation space around portions other than end portions of a coil.

SUMMARY

Regarding the coil component of Japanese Unexamined Patent Application Publication No. 2017-59749, no stress relaxation space is formed around the end portions of the coil. However, the adhesiveness between a coil conductor and the element assembly is insufficient, and there is a concern that a plating solution may enter between the coil conductor and the element assembly during plating and the reliability of the coil may be degraded. Accordingly, the present disclosure provides a coil component in which the adhesiveness between a coil conductor and an element assembly is high in an extension portion and in which the extension portion can be sealed reliably.

The present inventors performed intensive research. As a result, it was found that, in a multilayer coil component including an element assembly including an insulator portion and a coil embedded in the insulator portion and composed of a plurality of coil conductors electrically connected to each other, an extension portion disposed at each end portion of the coil, and an outer electrode disposed on the surface of the insulator portion and electrically connected to the extension portion, the adhesiveness between a coil conductor and the element assembly in the extension portion could be improved and the extension portion could be sealed more reliably by setting the thickness of the coil conductor in the extension portion to be greater than the thickness of the coil conductor in a winding portion. Consequently, permeation of the element assembly by a plating solution, water, and the like can be suppressed. Therefore, the multilayer coil component according to preferred embodiments of the present disclosure has high reliability.

Preferred embodiments of the present disclosure include the following aspects.

(1) A multilayer coil component including an element assembly that includes an insulator portion and a coil embedded in the insulator portion and composed of a plurality of coil conductors electrically connected to each other, an extension portion disposed at each end portion of the coil, and an outer electrode disposed on the surface of the insulator portion and electrically connected to the extension portion. The thickness of the coil conductor in the extension portion of the coil is about 1.05 times or more and 2.0 times or less (i.e., from about 1.05 times to 2.0 times) the thickness of the coil conductor in a winding portion of the coil.

(2) The multilayer coil component according to (1) above, wherein the thickness of the coil conductor in the extension portion is about 40 μm or more and 80 μm or less (i.e., from about 40 μm to 80 μm).

(3) The multilayer coil component according to (1) or (2) above, wherein the thickness of the coil conductor in the winding portion is about 20 μm or more and 50 μm or less (i.e., from about 20 μm to 50 μm).

(4) The multilayer coil component according to any one of (1) to (3) above, wherein a clearance is formed in at least part of the boundary between the coil conductor in the winding portion and the insulator portion in the element assembly.

(5) A method for manufacturing a multilayer coil component including an element assembly that includes an insulator portion and a coil embedded in the insulator portion and composed of a plurality of coil conductors electrically connected to each other, an extension portion disposed at each end portion of the coil, and an outer electrode disposed on the surface of the insulator portion and electrically connected to the extension portion, the method including forming a first conductive paste layer of a first conductive paste on a portion to serve as the extension portion of the coil and forming a second conductive paste layer of a second conductive paste on at least a portion to serve as a winding portion of the coil. The shrinkage of the first conductive paste during firing is less than the shrinkage of the second conductive paste.

Other features, elements, characteristics and advantages of the present disclosure will become more apparent from the following detailed description of preferred embodiments of the present disclosure with reference to the attached drawings.

DETAILED DESCRIPTION

The multilayer coil component 1 according to an embodiment of the present disclosure will be described below in detail with reference to the drawings. In this regard, the shapes, arrangements, and the like of the multilayer coil component and constituent elements of the present embodiment are not limited to the examples illustrated.

Figure 1:
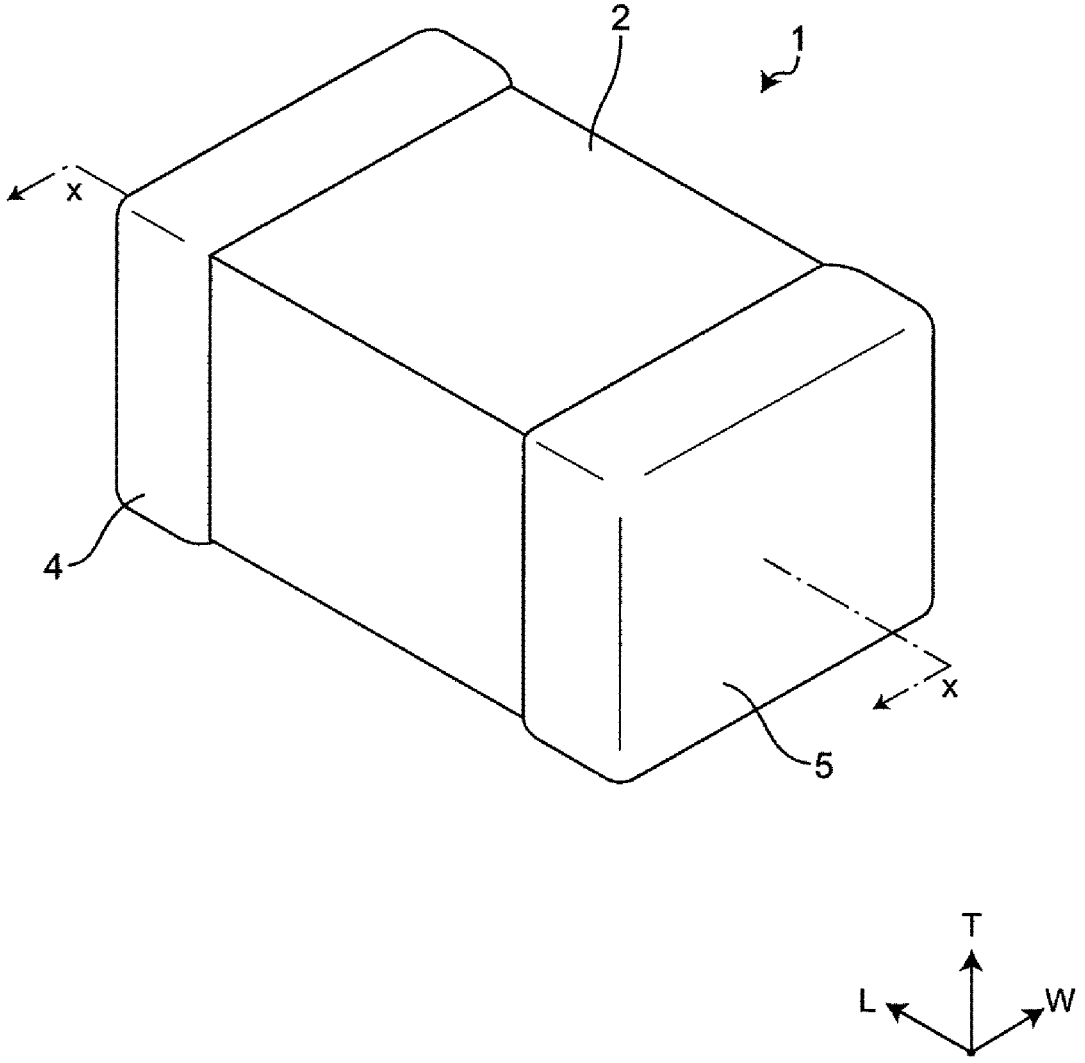
FIG. 1 is a schematic perspective view showing a multilayer coil component according to an embodiment of the present disclosure.
Figure 2:
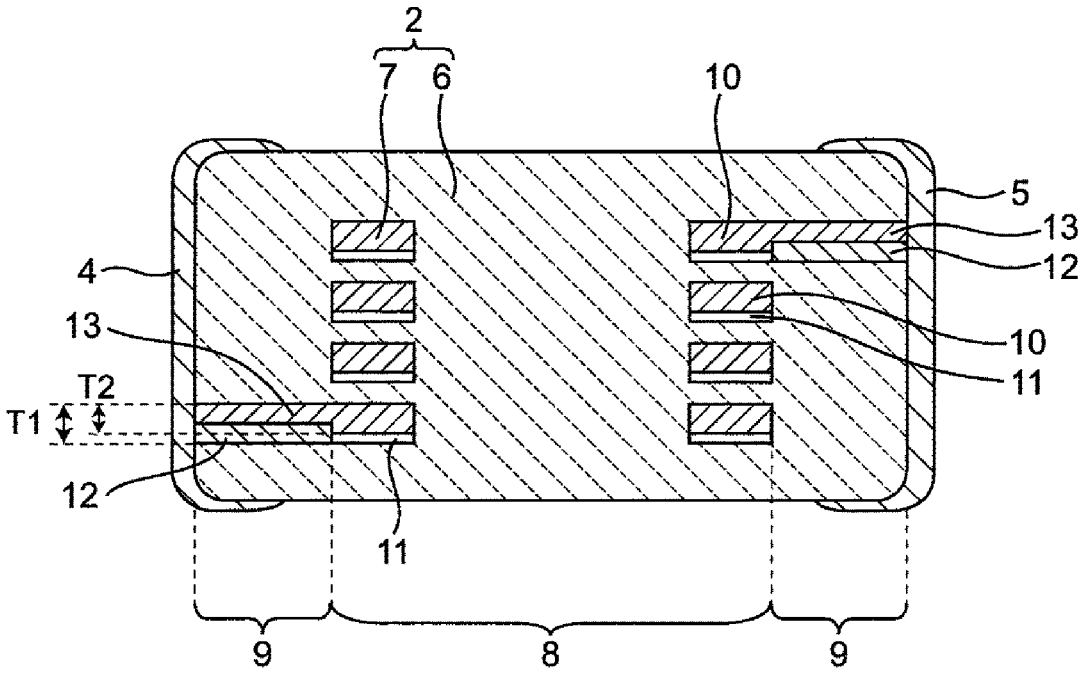
FIG. 2 is a sectional view showing a cut surface of the multilayer coil component along line x-x in FIG. 1.

FIG. 1 is a schematic perspective view showing a multilayer coil component 1 according to the present embodiment, and FIG. 2 is a schematic sectional view cut along line x-x. In this regard, the shapes, arrangements, and the like of the multilayer coil component and constituent elements of the present embodiment described below are not limited to the examples illustrated.

As shown in FIG. 1 and FIG. 2, the multilayer coil component 1 according to the present embodiment is a substantially rectangular parallelepiped multilayer coil component. In the multilayer coil component 1, the surfaces perpendicular to the L-axis in FIG. 1 are denoted as "end surfaces", the surfaces perpendicular to the W-axis are denoted as "side surfaces", and the surface perpendicular to the T-axis is denoted as an "upper surface" or a "lower surface". Briefly, the multilayer coil component 1 includes an element assembly 2 and outer electrodes 4 and 5 disposed on the respective end surfaces of the element assembly 2. The element assembly 2 includes an insulator portion 6 and a coil 7 embedded in the insulator portion 6. The coil 7 includes a winding portion 8 and extension portions 9. The extension portions 9 are disposed on the respective end portions of the coil 7 and are electrically connected to the corresponding outer electrodes 4 and 5. A plurality of coil conductors 10 constitute the coil 7 by being electrically connected to each other. A clearance 11 is formed at the boundary between one principal surface (lower principal surface in FIG. 2) of the coil conductor 10 and the insulator portion 6. Generation of stress between the coil conductor 10 and the insulator portion 6 in the winding portion 8 can be suppressed by the clearance.

As described above, in the multilayer coil component 1 according to the present embodiment, the element assembly 2 includes the insulator portion 6 and the coil 7.

The insulator portion 6 is formed of preferably a magnetic body and further preferably sintered ferrite. The sintered ferrite contains at least Fe, Ni, and Zn as primary components. The sintered ferrite may further contain Cu.

According to an aspect, the sintered ferrite contains at least Fe, Ni, Zn, and Cu as primary components.

In the sintered ferrite, the Fe content in terms of $Fe_2O_3$ is preferably about 40.0% by mole or more and 49.5% by mole or less (i.e., from about 40.0% by mole to 49.5% by mole) (with reference to total primary components; the same applies hereafter) and more preferably about 45.0% by mole or more and 49.5% by mole or less (i.e., from about 45.0% by mole to 49.5% by mole).

In the sintered ferrite, the Zn content in terms of ZnO is preferably about 5.0% by mole or more and 35.0% by mole or less (i.e., from about 5.0% by mole to 35.0% by mole) (with reference to total primary components; the same applies hereafter) and more preferably about 10.0% by mole or more and 30.0% by mole or less (i.e., from about 10.0% by mole to 30.0% by mole).

In the sintered ferrite, the Cu content in terms of CuO is preferably about 4.0% by mole or more and 12.0% by mole or less (i.e., from about 4.0% by mole to 12.0% by mole) (with reference to total primary components; the same applies hereafter) and more preferably about 7.0% by mole or more and 10.0% by mole or less (i.e., from about 7.0% by mole to 10.0% by mole).

In the sintered ferrite, there is no particular limitation regarding the Ni content, and the Ni content may be the remainder of the content of the primary components, that is, the content other than the content of Fe, Zn, and Cu described above.

According to an aspect, in the sintered ferrite, the content of Fe in terms of $Fe_2O_3$ is about 40.0% by mole or more and 49.5% by mole or less (i.e., from about 40.0% by mole to 49.5% by mole), the content of Zn in terms of ZnO is about 5.0% by mole or more and 35.0% by mole or less (i.e., from about 5.0% by mole to 35.0% by mole), the content of Cu in terms of CuO is about 4.0% by mole or more and 12.0% by mole or less (i.e., from about 4.0% by mole to 12.0% by mole), and the content of NiO is the remainder.

The sintered ferrite according to embodiments of the present disclosure may further contain additional components. Examples of additional components in the sintered ferrite include Mn, Co, Sn, Bi, and Si, but the additional components are not limited to these. The content (amount of addition) of each of Mn, Co, Sn, Bi, and Si in terms of $Mn_3O_4$, $Co_3O_4$, $SnO_2$, $Bi_2O_3$, and $SiO_2$, respectively, is preferably about 0.1 parts by weight or more and 1 part by weight or less (i.e., from about 0.1 parts by weight to 1 part by weight) relative to 100 parts by weight of the total primary components (Fe (in terms of $Fe_2O_3$), Zn (in terms of ZnO), Cu (in terms of CuO), and Ni (in terms of NiO)). In addition, the sintered ferrite may contain incidental impurities during production.

The sintered ferrite may further contain, for example, Mn, Co, Sn, Bi, and Si as additional components. Examples of additional components in the sintered ferrite include Mn, Co, Sn, Bi, and Si, but the additional components are not limited to these. The content (amount of addition) of each of Mn, Co, Sn, Bi, and Si in terms of $Mn_3O_4$, $Co_3O_4$, $SnO_2$, $Bi_2O_3$, and $SiO_2$, respectively, is preferably about 0.1 parts by weight or more and 1 part by weight or less (i.e., from about 0.1 parts by weight to 1 part by weight) relative to 100 parts by weight of the total primary components (Fe (in terms of $Fe_2O_3$), Zn (in terms of ZnO), Cu (in terms of CuO), and Ni (in terms of NiO)). In addition, the sintered ferrite may contain incidental impurities during production.

As described above, the coil 7 is formed by coil conductors 10 being electrically connected to each other. The coil conductors 10 contain a conductive material. Preferably, the coil conductors 10 are substantially formed of a conductive material. There is no particular limitation regarding the conductive material, and examples include Au, Ag, Cu, Pd, and Ni. The conductive material is preferably Ag or Cu and more preferably Ag. The conductive materials may be used alone, or at least two types may be used in combination.

In the coil 7, the thickness T1 of the coil conductor 10 in the extension portion 9 is greater than the thickness T2 of the coil conductor 10 in the winding portion 8. The adhesiveness between the coil conductor and the insulator portion in the extension portion is improved by setting T1 to be greater than T2.

The thickness of the coil conductor 10 in the extension portion 9 of the coil 7 is about 1.05 times or more and 2.0 times or less (i.e., from about 1.05 times to 2.0 times) the thickness of the coil conductor 10 in the winding portion 8. That is, T1/T2 is about 1.05 or more and 2.0 or less (i.e., from about 1.05 to 2.0). T1/T2 is preferably about 1.1 or more and 1.8 or less (i.e., from about 1.1 to 1.8), and more preferably about 1.2 or more and 1.6 or less (i.e., from about 1.2 to 1.6). The adhesiveness between the extension portion and the insulator portion is improved and such a portion is sealed more reliably by setting T1/T2 to be about 1.05 or more. Meanwhile, cracking and the like can be suppressed from occurring by setting T1/T2 to be about 2.0 or less.

The thickness of the coil conductor 10 in the extension portion 9 is preferably about 40 μm or more and 80 μm or less (i.e. from about 40 μm to 80 μm) and more preferably about 45 μm or more and 65 μm or less (i.e., from about 45 μm to 65 μm).

The thickness of the coil conductor 10 in the winding portion 8 is preferably about 20 μm or more and 50 μm or less (i.e., from about 20 μm to 50 μm) and more preferably about 30 μm or more and 40 μm or less (i.e., from about 30 μm to 40 μm).

The thickness of the coil conductor 10 in each of the winding portion 8 and the extension portion 9 is the thickness in the stacking direction and can be measured as described below.

Polishing is performed while the LT plane of a chip faces abrasive paper, and polishing is stopped at a substantially central portion of the extension portion. Thereafter, ion milling treatment is performed, and observation is performed by using a microscope. The thickness of the extension portion is measured at the position about ⅓ the extension length from the extension portion end surface portion by a measurement device attached to the microscope.

According to an aspect, in the coil conductor 10 in the extension portion 9 of the coil 7, a low-shrinkage layer 12 with relatively low shrinkage during firing and a high-shrinkage layer 13 with relatively high shrinkage are stacked. Stacking a low-shrinkage layer with relatively low shrinkage during firing in the extension portion suppresses shrinkage during firing, suppresses a gap from occurring between the coil conductor and the insulator portion in the extension portion, and improves the adhesiveness between the coil conductor and the insulator portion in the extension portion.

Meanwhile, the coil conductor 10 in the winding portion 8 of the coil 7 may be a high-shrinkage layer with relatively high shrinkage during firing. Setting the coil conductor 10 in the winding portion 8 to be a high-shrinkage layer with relatively high shrinkage during firing and performing firing enable a clearance 11 serving as a stress relaxation space to be formed more reliably.

According to an aspect, the low-shrinkage layer 12 is formed of a material having a shrinkage of 10% or more and 15% or less (i.e., from 10% to 15%) and preferably 10% or more and 13% or less (i.e., from 10% to 13%).

According to an aspect, the high-shrinkage layer 13 is formed of a material having a shrinkage of 20% or more and 25% or less (i.e., from 20% to 25%) and preferably 22% or more and 25% or less (i.e., from 22% to 25%).

In the coil conductor 10 in the extension portion 9, the ratio of the thickness of the low-shrinkage layer 12 to the thickness of the high-shrinkage layer 13 ((low-shrinkage layer)/(high-shrinkage layer)) is preferably about 1.1 or more and 3.0 or less (i.e., from about 1.1 to 3.0) and more preferably about 1.5 or more and 2.5 or less (i.e., from about 1.5 to 2.5).

The clearance 11 functions as a so-called stress relaxation space. The thickness of the clearance 11 is preferably 1 μm or more and 30 μm or less (i.e., from 1 μm to 30 μm) and more preferably 5 μm or more and 15 μm or less (i.e., from 5 μm to 15 μm).

The thickness of the clearance 11 is a thickness in the stacking direction and can be measured as described below.

Polishing is performed while the LT plane of a chip faces abrasive paper, and polishing is stopped at a substantially central portion of the dimension in the W-direction of the coil conductor. Thereafter, observation is performed by using a microscope. The clearance thickness of the position at a substantially central portion of the dimension in the L-direction of the coil conductor is measured by a measurement device attached to the microscope.

As described above, in the multilayer coil component 1 according to embodiments of the present disclosure, the outer electrodes 4 and 5 are disposed so as to cover the respective end surfaces of the element assembly 2. The outer electrode is formed of a conductive material, preferably at least one metal material selected from Au, Ag, Pd, Ni, Sn, and Cu.

The outer electrode may be a single layer or a multilayer. According to an aspect, the outer electrode is a multilayer, preferably two layers or more and four layers or less, for example, three layers.

According to an aspect, the outer electrode is a multilayer and may include a layer containing Ag or Pd, a layer containing Ni, or a layer containing Sn. In a preferred aspect, the outer electrode is composed of a layer containing Ag or Pd, a layer containing Ni, and a layer containing Sn. Preferably, the above-described layers are disposed, from the coil conductor, in the order of the layer containing Ag or Pd, preferably Ag, the layer containing Ni, and the layer containing Sn. Preferably, the layer containing Ag or Pd is a layer with a baked Ag paste or a baked Pd paste, and each of the layer containing Ni and the layer containing Sn may be a plating layer.

The multilayer coil component 1 according to the present embodiment is produced as described below, for example. In the present embodiment, an aspect in which the insulator portion 6 is formed of a ferrite material will be described.

(1) Preparation of Ferrite Paste

A ferrite material is prepared. The ferrite material contains Fe, Zn, and Ni as primary components and further contains Cu as the situation demands. Usually, the primary components of the ferrite material are substantially composed of oxides of Fe, Zn, Ni, and Cu (ideally $Fe_2O_3$, ZnO, NiO, and CuO).

Regarding the ferrite material, $Fe_2O_3$, ZnO, CuO, NiO, and, as the situation demands, additional components are weighed, mixed, and pulverized such that a predetermined composition is ensured. The resulting ferrite material is dried and calcined so as to obtain a calcined powder. Respective predetermined amounts of solvent (ketone-based solvent or the like), resin (polyvinyl acetal or the like), and plasticizer (alkyd-based plasticizer or the like) are added to the resulting calcined powder, and kneading is performed by a planetary mixer or the like. Thereafter, dispersion is further performed by using a three-roll mill or the like and, thereby, a ferrite paste can be produced.

In the ferrite material, the Fe content in terms of $Fe_2O_3$ is preferably about 40.0% by mole or more and 49.5% by mole or less (i.e., from about 40.0% by mole to 49.5% by mole) (with reference to total primary components; the same applies hereafter) and more preferably about 45.0% by mole or more and 49.5% by mole or less (i.e., from about 45.0% by mole to 49.5% by mole).

In the ferrite material, the Zn content in terms of ZnO is preferably about 5.0% by mole or more and 35.0% by mole or less (i.e., from about 5.0% by mole to 35.0% by mole) (with reference to total primary components; the same applies hereafter) and more preferably about 10.0% by mole or more and 30.0% by mole or less (i.e., from about 10.0% by mole to 30.0% by mole).

In the ferrite material, the Cu content in terms of CuO is preferably about 4.0% by mole or more and 12.0% by mole or less (i.e., from about 4.0% by mole to 12.0% by mole) (with reference to total primary components; the same applies hereafter) and more preferably about 7.0% by mole or more and 10.0% by mole or less (i.e., from about 7.0% by mole to 10.0% by mole).

In the ferrite material, there is no particular limitation regarding the Ni content, and the Ni content may be the remainder of the content of the primary components, that is, the content other than the content of Fe, Zn, and Cu described above.

According to an aspect, in the ferrite material, the content of Fe in terms of $Fe_2O_3$ is about 40.0% by mole or more and 49.5% by mole or less (i.e., from about 40.0% by mole to 49.5% by mole), the content of Zn in terms of ZnO is about 5.0% by mole or more and 35.0% by mole or less (i.e., from about 5.0% by mole to 35.0% by mole), the content of Cu in terms of CuO is about 4.0% by mole or more and 12.0% by mole or less (i.e., from about 4.0% by mole to 12.0% by mole), and the content of NiO is the remainder.

The ferrite material according to embodiments of the present disclosure may further contain additional components. Examples of additional components in the ferrite material include Mn, Co, Sn, Bi, and Si, but the additional components are not limited to these. The content (amount of addition) of each of Mn, Co, Sn, Bi, and Si in terms of $Mn_3O_4$, $Co_3O_4$, $SnO_2$, $Bi_2O_3$, and $SiO_2$, respectively, is preferably about 0.1 parts by weight or more and 1 part by weight or less (i.e., from about 0.1 parts by weight to 1 part by weight) relative to 100 parts by weight of the total primary components (Fe (in terms of $Fe_2O_3$), Zn (in terms of ZnO), Cu (in terms of CuO), and Ni (in terms of NiO)). In addition, the ferrite material may contain incidental impurities during production.

In this regard, it may be conjectured that the Fe content (in terms of $Fe_2O_3$), the Mn content (in terms of $Mn_2O_3$), the Cu content (in terms of CuO), the Zn content (in terms of ZnO), and the Ni content (in terms of NiO) in the sintered ferrite are substantially the same as the Fe content (in terms of $Fe_2O_3$), the Mn content (in terms of $Mn_2O_3$), the Cu content (in terms of CuO), the Zn content (in terms of ZnO), and the Ni content (in terms of NiO), respectively, in the ferrite material before firing.

(2) Preparation of Coil Conductor Conductive Paste

Conductive materials are prepared. Examples of the conductive material include Au, Ag, Cu, Pd, and Ni. Of these, Ag or Cu is preferable, and Ag is more preferable. A predetermined amount of conductive material powder is weighed and kneaded with a predetermined amount of solvent (eugenol or the like), resin (ethyl cellulose or the like), and dispersing agent by a planetary mixer or the like. Thereafter, dispersion is further performed by using a three-roll mill or the like and, thereby, a coil conductor conductive paste can be produced.

Regarding preparation of the conductive paste, two types of conductive pastes (A) and (B) having different shrinkages during firing are produced by adjusting the pigment volume concentration (PVC) that is a concentration of the volume of the conductive material relative to the total volume of the conductive material (typically silver powder) and the resin component in the conductive paste.

(A) High shrinkage conductive paste: paste having high shrinkage (typically shrinkage of 20% or more and 25% or less (i.e., from 20% to 25%))

(B) Low shrinkage conductive paste: paste having low shrinkage (typically shrinkage of 10% or more and 15% or less (i.e., from 10% to 15%))

In this regard, the shrinkage may be determined by, for example, coating a polyethylene terephthalate (PET) film with the conductive paste, performing drying and cutting into the size of about 5 mm×5 mm, and measuring a change in the sample dimension by using a thermomechanical analyzer (TMA).

(3) Preparation of Resin Paste

A resin paste for forming the clearance 11 in the multilayer coil component 1 is prepared. The resin paste may be produced by mixing a resin (acrylic resin or the like) that disappears during firing into a solvent (isophorone or the like).

Figure 3A:
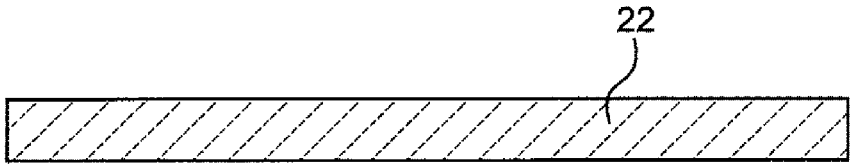
FIGS. 3A and 3B are sectional views illustrating the method for manufacturing the multilayer coil component shown in FIG. 1 and showing cross sections that include an extension portion and that are a cross section parallel to the WT plane and a cross section parallel to the LT plane, respectively.
Figure 3B:
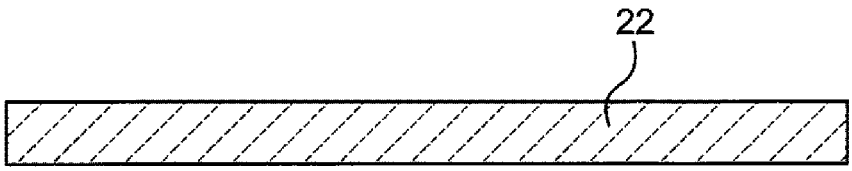

(4) Production of Multilayer Coil Component (4-1) Production of Element Assembly A substrate (not shown in the drawing) in which a thermal release sheet and a polyethylene terephthalate (PET) film are stacked on a metal plate is prepared. The substrate is printed with the ferrite paste predetermined times so as to form a ferrite paste layer 22 serving as an outer layer (FIGS. 3A and 3B).

Figure 4A:
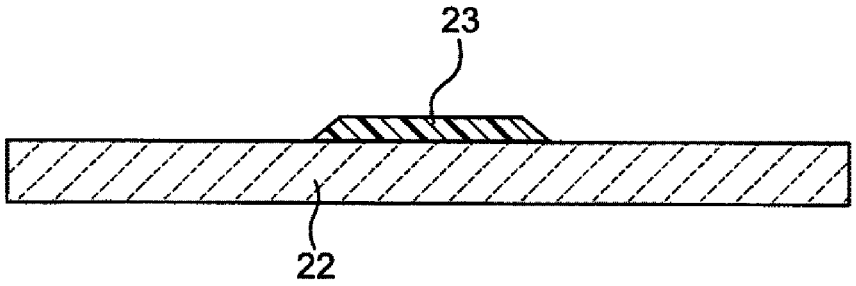
FIGS. 4A and 4B are sectional views illustrating the method for manufacturing the multilayer coil component shown in FIG. 1 and showing cross sections that include an extension portion and that are a cross section parallel to the WT plane and a cross section parallel to the LT plane, respectively.
Figure 4B:
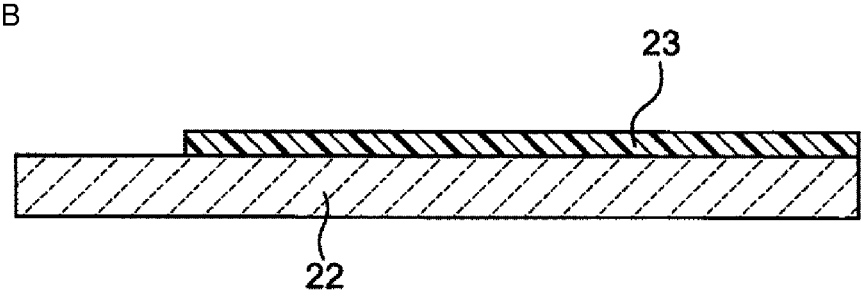

A place on which a clearance 11 is to be formed (that is, a place to be provided with a coil conductor excluding an extension portion) is printed with the above-described resin paste so as to form a resin paste layer 23 (FIGS. 4A and 4B).

Figure 5A:
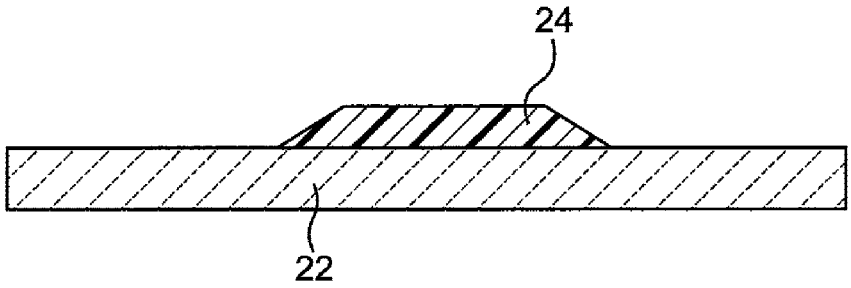
FIGS. 5A and 5B are sectional views illustrating the method for manufacturing the multilayer coil component shown in FIG. 1 and showing cross sections that include an extension portion and that are a cross section parallel to the WT plane and a cross section parallel to the LT plane, respectively.
Figure 5B:
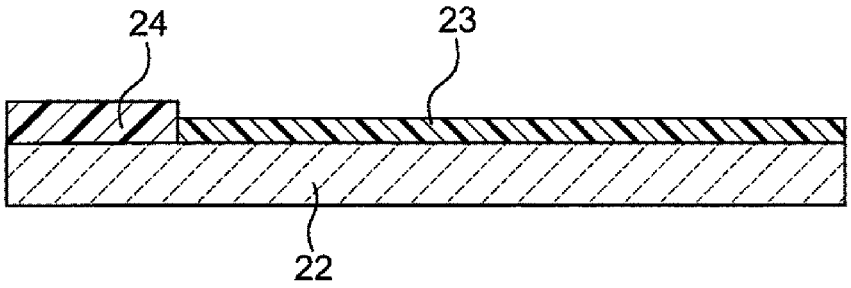

A place to be provided with the extension portion is printed with the low shrinkage conductive paste so as to form a low shrinkage conductive paste layer 24 (FIGS. 5A and 5B).

Figure 6A:
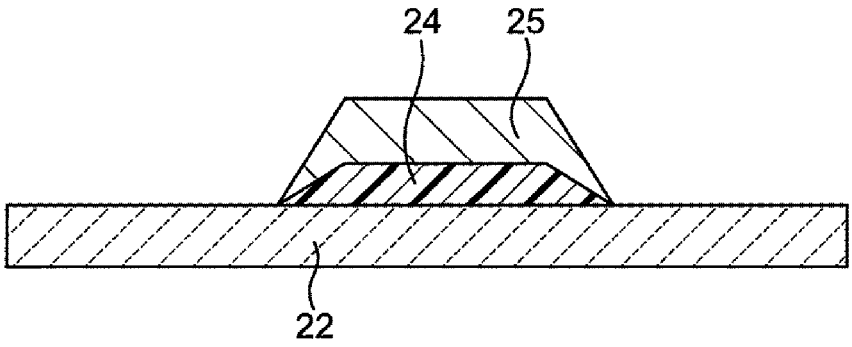
FIGS. 6A and 6B are sectional views illustrating the method for manufacturing the multilayer coil component shown in FIG. 1 and showing cross sections that include an extension portion and that are a cross section parallel to the WT plane and a cross section parallel to the LT plane, respectively.
Figure 6B:
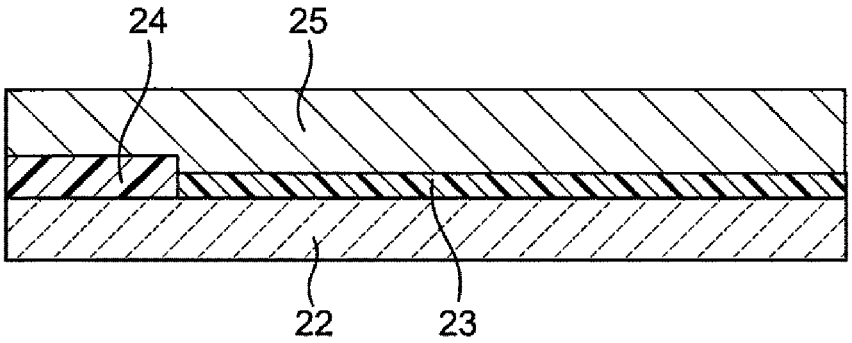

The entire place to be provided with the coil conductor is printed with the high shrinkage conductive paste so as to form a high shrinkage conductive paste layer 25 (FIGS. 6A and 6B).

Figure 7A:
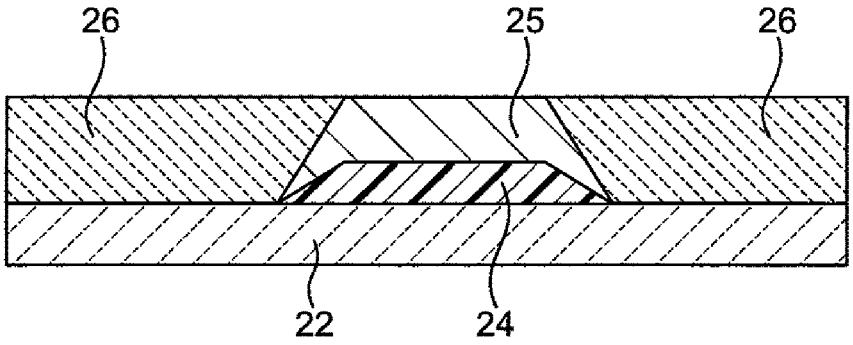
FIGS. 7A and 7B are sectional views illustrating the method for manufacturing the multilayer coil component shown in FIG. 1 and showing cross sections that include an extension portion and that are a cross section parallel to the WT plane and a cross section parallel to the LT plane, respectively.
Figure 7B:
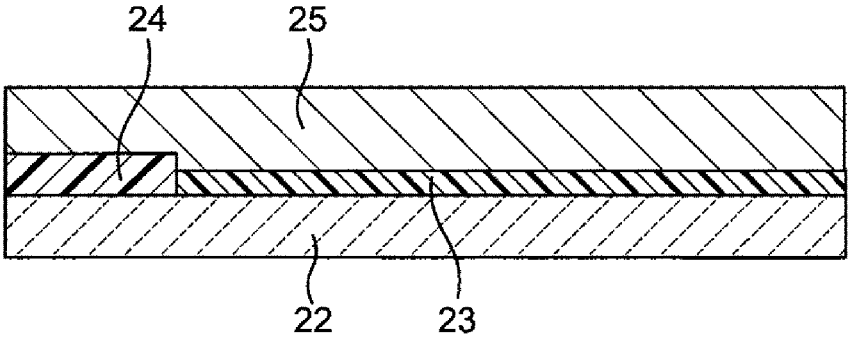

The region provided with neither low shrinkage conductive paste layer 24 nor high shrinkage conductive paste layer 25 is printed with the ferrite paste such that the height becomes the same as the height of the conductive paste layer so as to form a ferrite paste layer 26 (FIGS. 7A and 7B).

Figure 8A:
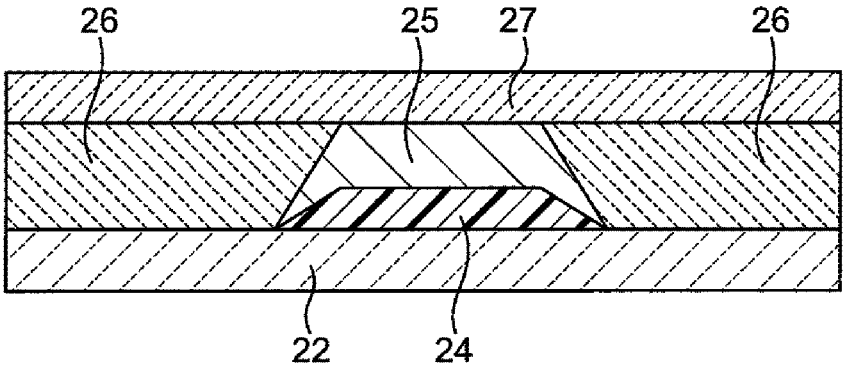
FIGS. 8A and 8B are sectional views illustrating the method for manufacturing the multilayer coil component shown in FIG. 1 and showing cross sections that include an extension portion and that are a cross section parallel to the WT plane and a cross section parallel to the LT plane, respectively.
Figure 8B:
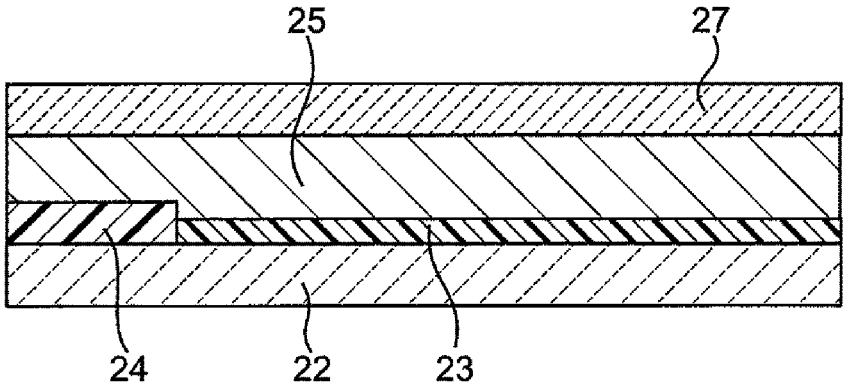

The entire surface is printed with the ferrite paste so as to form a ferrite paste layer 27 (FIGS. 8A and 8B).

The printing operations of the resin paste layer 23 (FIGS. 4A and 4B), the low shrinkage conductive paste layer 24 (FIGS. 5A and 5B), the high shrinkage conductive paste layer 25 (FIGS. 6A and 6B), the ferrite paste layer 26 (FIGS. 7A and 7B), and the ferrite paste layer 27 (FIGS. 8A and 8B) are successively repeated predetermined times so as to form a coil pattern. Finally, printing with the ferrite paste is performed predetermined times so as to form a ferrite paste layer serving as the outer layer, and, thereby, a multilayer body block that is an aggregate of elements is obtained on the substrate.

The layers are pressure-bonded while the multilayer body block is attached to the substrate. Thereafter, the multilayer body block is cooled. After cooling is performed, the metal plate and the PET film are successively peeled off the multilayer body block. The resulting multilayer body block is cut by a dicer or the like into individual elements.

Each resulting element is subjected to barrel treatment so as to cut and round the corners of the element. The barrel treatment may be applied to an unfired multilayer body or to a multilayer body after being fired. The barrel treatment may be either a dry type or a wet type. The barrel treatment may be a method in which elements are rubbed with each other or a method in which barrel treatment is performed with media.

After the barrel treatment is performed, each element is fired at a temperature of, for example, about 910° C. or higher and 930° C. or lower (i.e., from about 910° C. to 930° C.) so as to obtain an element assembly 2 of the multilayer coil component 1.

(4-2) Formation of Outer Electrode

Each end surface of the element assembly 2 is coated with an outer-electrode-forming Ag paste containing Ag and glass and baking is performed so as to form an underlying electrode. An outer electrode is formed by successively forming a Ni coating and a Sn coating on the underlying electrode by electroplating so as to obtain the multilayer coil component 1 shown in FIG. 1.

An embodiment of the present disclosure provides the above-described manufacturing method, specifically a method for manufacturing a multilayer coil component including an element assembly that includes an insulator portion and a coil embedded in the insulator portion and composed of a plurality of coil conductors electrically connected to each other, an extension portion disposed at each end portion of the coil, and an outer electrode disposed on the surface of the insulator portion and electrically connected to the extension portion, the method including forming a first conductive paste layer (corresponding to the low shrinkage conductive paste layer 24) of a first conductive paste on a portion to serve as the extension portion of the coil and forming a second conductive paste layer (corresponding to the high shrinkage conductive paste layer 25) of a second conductive paste on at least a portion to serve as a winding portion of the coil, wherein the shrinkage of the first conductive paste during firing is less than the shrinkage of the second conductive paste.

A manufacturing method according to a preferred aspect of the present disclosure is a method for manufacturing a multilayer coil component including an element assembly that includes an insulator portion and a coil embedded in the insulator portion and composed of a plurality of coil conductors electrically connected to each other, an extension portion disposed at each end portion of the coil, and an outer electrode disposed on the surface of the insulator portion and electrically connected to the extension portion, the method including forming a first insulating layer (corresponding to the ferrite paste layer 22), forming a first conductive paste layer (corresponding to the low shrinkage conductive paste layer 24) of a first conductive paste on a portion, on the first insulating layer, to serve as the extension portion of the coil, forming a second conductive paste layer (corresponding to the high shrinkage conductive paste layer 25) of a second conductive paste on the entire portion, on the first insulating layer, to serve as the coil conductor portion, forming a second insulating layer (corresponding to the ferrite paste layer 26) in a region provided with neither the first conductive paste layer nor the second conductive paste layer on the first insulating layer, and forming a third insulating layer (corresponding to the ferrite paste layer 27) on the second insulating layer, wherein the shrinkage of the first conductive paste during firing is less than the shrinkage of the second conductive paste.

Up to this point, the embodiment according to the present disclosure has been described. However, the present embodiment may be variously modified.

EXAMPLES

Example

Preparation of Ferrite Paste

Powders of $Fe_2O_3$, ZnO, CuO, and NiO were weighed in amounts of 49.0% by mole, 25.0% by mole, 8.0% by mole, and the remainder, respectively, relative to the total of each primary component. The resulting powders were mixed, pulverized, dried, and calcined at 700° C. so as to obtain a calcined powder. Predetermined amounts of ketone-based solvent, polyvinyl acetal, and alkyd-based plasticizer were added to the resulting calcined powder, and kneading was performed by a planetary mixer. Thereafter, dispersion was further performed by using a three-roll mill and, thereby, a ferrite paste was produced.

Preparation of Coil Conductor Conductive Paste

A predetermined amount of silver powder was prepared as the conductive material and kneaded with eugenol, ethyl cellulose, and a dispersing agent by using a planetary mixer. Thereafter, dispersion was performed by using a three-roll mill and, thereby, a coil conductor conductive paste was produced.

Regarding preparation of the conductive paste, two types of conductive pastes (A) and (B) having different shrinkages during firing were produced by adjusting the PVC.

(A) High shrinkage conductive paste (shrinkage of 22% at 800° C.)

(B) Low shrinkage conductive paste (shrinkage of 16% at 800° C.)

Preparation of Resin Paste

A resin paste was prepared by mixing an acrylic resin into isophorone.

Production of Multilayer Coil Component (Examples 1 to 7)

A multilayer body block that was an aggregate was obtained in the procedure shown in FIG. 3A to FIG. 8B by using the ferrite paste, the high shrinkage conductive paste, the low shrinkage conductive paste, and the resin paste. The samples of examples 1 to 7 were set to have a respective total thickness of the high shrinkage conductive paste layer and the low shrinkage conductive paste layer in the extension portion of 73, 75, 80, 90, 99, 108, and 118 μm, and the thickness of the high shrinkage conductive paste layer in the winding portion was set to be 70 μm. The thickness of the ferrite paste layer interposed between the high shrinkage conductive paste layers in the winding portion was set to be 20 μm.

The layers were pressure-bonded while the multilayer body block was attached to the substrate. Thereafter, the multilayer body block was cooled. After cooling was performed, the metal plate and the PET film were successively peeled off the multilayer body block. The resulting multilayer body block was cut by a dicer or the like into individual elements. Each resulting element was subjected to barrel treatment so as to cut and round the corners of the element. After the barrel treatment was performed, each element was fired at a temperature of 920° C. so as to obtain an element assembly.

Each end surface of the element assembly was coated with an outer-electrode-forming Ag paste containing Ag and glass and baking was performed so as to form an underlying electrode. An outer electrode was formed by successively forming a Ni coating and a Sn coating on the underlying electrode by electroplating so as to obtain the multilayer coil component of the example.

Comparative Example

A multilayer coil component of a comparative example was obtained in the same manner as the example except that the low shrinkage conductive paste layer shown in FIGS. 5A and 5B was not formed.

Evaluation

External Dimensions

Regarding each sample (multilayer coil component) of the examples and the comparative example, L (length)=1.6 mm, W (width)=0.8 mm, and T (height)=0.8 mm were applied.

Defect in Extension Portion

Regarding 20 samples of each of the examples and the comparative example, each sample was placed upright and encased in a resin. At this time, the LT side surface was exposed. Polishing was performed in the W-direction of the sample by using a polishing machine, and polishing was stopped at the depth at which a substantially central portion of the extension portion was exposed so as to expose the LT cross section. After polishing was finished, to remove sagging of the coil conductor due to polishing, the polished surface was processed by ion milling (Ion Milling System IM4000 produced by Hitachi High-Technologies Corporation). The extension portion was observed by using a SE, and the number of samples in which a gap was formed between the extension portion and the ferrite layer was counted. As a result, the number of samples was 0 regarding each example, and the number of samples was 20 regarding the comparative example.

Dimensions of Extension Portion

The thickness of the coil conductor in the extension portion and the thickness of the coil conductor in the winding portion of the polished sample of the example, as described above, were measured. Regarding each of the examples 1 to 7, three samples were measured, and the average of these measurements was determined. As a result, the coil conductors in the extension portions of examples 1 to 7 had a respective thickness of 42, 44, 48, 57, 64, 72, and 80 μm, and the thickness of each coil conductor in the winding portion was 40.0 μm. Likewise, regarding the sample printed with no low shrinkage conductive paste of the comparative example, the thickness of the coil conductor in the extension portion and the thickness of the coil conductor in the winding portion were measured. Three samples were measured, and the average of these measurements was determined. As a result, the thickness of the coil conductor in the extension portion was 40.0 μm, and the thickness of the coil conductor in the winding portion was 40.0 μm. The results are summarized in Table 1 below.

TABLE 1

| | Thickness in winding portion (μm) | Thickness in extension portion (μm) | (Extension portion)/(winding portion) |
|---|---|---|---|
| Example 1 | 40 | 42 | 1.05 |
| Example 2 | 40 | 44 | 1.1 |
| Example 3 | 40 | 48 | 1.2 |
| Example 4 | 40 | 56.8 | 1.42 |
| Example 5 | 40 | 64 | 1.6 |
| Example 6 | 40 | 72 | 1.8 |
| Example 7 | 40 | 80 | 2.0 |
| Comparative example | 40 | 40 | 1.0 |

The multilayer coil component according to preferred embodiments of the present disclosure may be widely used for various applications, for example, inductors.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A multilayer coil component comprising:

an element assembly that includes an insulator portion and a coil embedded in the insulator portion and composed of a plurality of coil conductors electrically connected to each other;

an extension portion disposed at each end portion of the coil; and an outer electrode disposed on the surface of the insulator portion and electrically connected to the extension portion, wherein a thickness of the coil conductor in the extension portion of the coil is from 1.05 times to 2.0 times a thickness of the coil conductor in a winding portion of the coil.

2. The multilayer coil component according to claim 1, wherein the thickness of the coil conductor in the extension portion is from 40 μm to 80 μm.

3. The multilayer coil component according to claim 1, wherein the thickness of the coil conductor in the winding portion is from 20 μm to 50 μm.

4. The multilayer coil component according to claim 1, wherein a clearance is formed in at least part of a boundary between the coil conductor in the winding portion and the insulator portion in the element assembly.

5. The multilayer coil component according to claim 2, wherein the thickness of the coil conductor in the winding portion is from 20 μm to 50 μm.

6. The multilayer coil component according to claim 2, wherein a clearance is formed in at least part of a boundary between the coil conductor in the winding portion and the insulator portion in the element assembly.

7. The multilayer coil component according to claim 3, wherein a clearance is formed in at least part of a boundary between the coil conductor in the winding portion and the insulator portion in the element assembly.

8. The multilayer coil component according to claim 5, wherein a clearance is formed in at least part of a boundary between the coil conductor in the winding portion and the insulator portion in the element assembly.

9. A method for manufacturing a multilayer coil component including an element assembly that includes an insulator portion and a coil embedded in the insulator portion and composed of a plurality of coil conductors electrically connected to each other, an extension portion disposed at each end portion of the coil, and an outer electrode disposed on the surface of the insulator portion and electrically connected to the extension portion, the method comprising:

forming a first conductive paste layer of a first conductive paste on a portion to serve as the extension portion of the coil; and forming a second conductive paste layer of a second conductive paste on at least a portion to serve as a winding portion of the coil, wherein shrinkage of the first conductive paste during firing is less than shrinkage of the second conductive paste.

10. The multilayer coil component according to claim 1, wherein the coil conductor in the winding portion of the coil being flush with the coil conductor in the extension portion of the coil.

* * * * *